United States Patent [19]

Knutsen

[11] Patent Number: 4,756,351

[45] Date of Patent: Jul. 12, 1988

[54] APPARATUS AND METHOD FOR SAWING LIMBS AND THE LIKE

[76] Inventor: Morris N. Knutsen, 3550 NW. Mountain View Rd., Silverdale, Wash. 98383

[21] Appl. No.: 54,434

[22] Filed: May 22, 1987

Related U.S. Application Data

[63] Continuation-in-part of Ser. No. 815,387, Dec. 31, 1985, Pat. No. 4,667,714.

[51] Int. Cl.[4] ..... B27B 1/00

[52] U.S. Cl. ..... 144/379; 182/178; 182/181; 269/130; 269/296

[58] Field of Search ..... 269/130, 131, 296; 144/193 R, 379; 182/178, 181, 154, 224

[56] References Cited

U.S. PATENT DOCUMENTS

| | | | |
|---|---|---|---|
| 194,229 | 8/1877 | Emery | 269/131 |
| 691,633 | 1/1902 | Jincks et al. | 269/131 |
| 2,815,131 | 12/1957 | Lunsman et al. | 214/1 |
| 3,371,458 | 3/1968 | Sturgill | 182/178 |
| 3,835,612 | 9/1974 | Beziat | 182/178 |
| 4,454,929 | 6/1984 | Wellman | 182/154 |
| 4,457,504 | 7/1984 | Mottla | 269/296 |
| 4,566,559 | 1/1986 | van Asten | 182/224 |

*Primary Examiner*—W. Donald Bray
*Attorney, Agent, or Firm*—Delbert J. Barnard

[57] ABSTRACT

A plurality of limbs or the like are secured together, to form a limb bundle (B). The limbs are positioned in a space defined laterally between a pair of posts (34, 38 or 80, 82) on one side (14) of a frame (12, 78) and a second pair of posts (36, 40 or 36', 40' or 86, 88) on the opposite side (16) of the frame (12, 78). A windlass (50, 52) is supported at the upper ends (46, 48) of the posts (34, 38 or 80, 82). A cable (60, 64) extends from the windlass (50) either downwardly and around the girth of the limb bundle (B), and then hooks on itself (62), to form a noose around the limb bundle (B), or it extends from the windlass (50) down to and around a pulley (68) then upwardly and over a mid portion of the limb bundle (B'), and then down to a dead end connection (66) at a lower portion of the frame (12). In either case, tightening of the cable (60, 64) imposes a squeezing force on the limb bundle (B, B').

25 Claims, 6 Drawing Sheets

Fig. 6
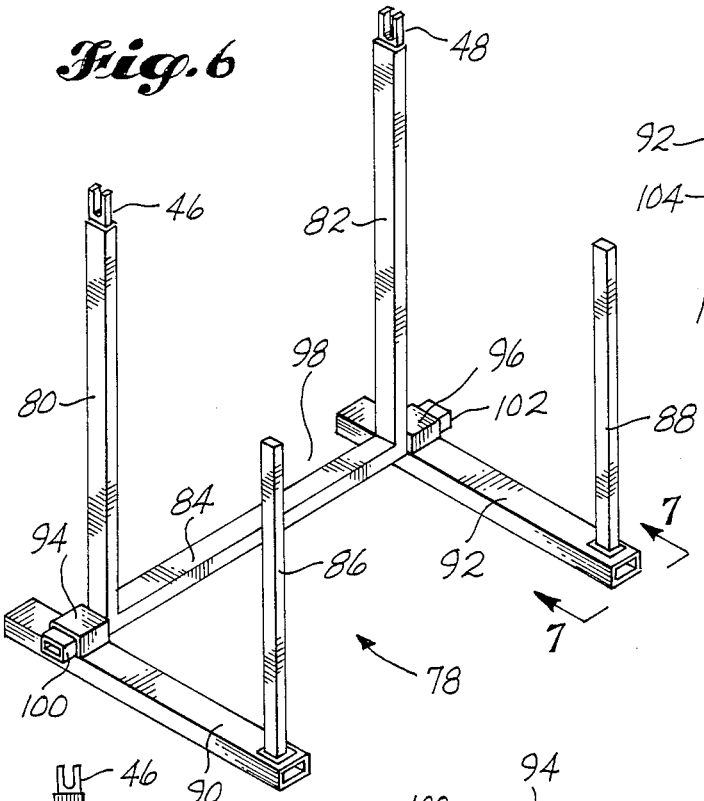
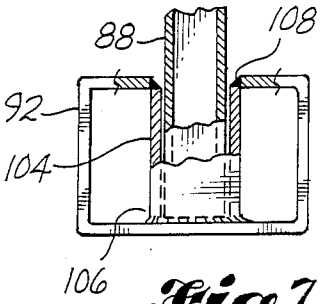
Fig. 7
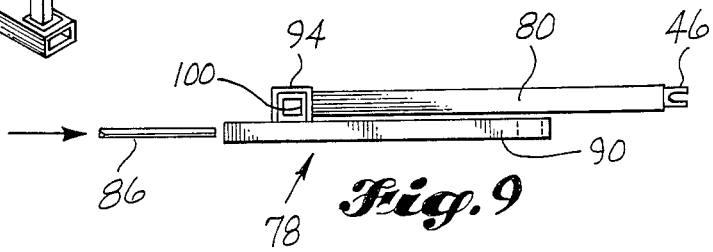
Fig. 9
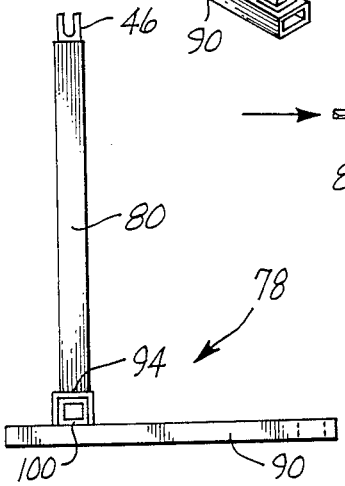
Fig. 8

APPARATUS AND METHOD FOR SAWING LIMBS AND THE LIKE

RELATED APPLICATION

This application is a continuation-in-part of my copending application Ser. No. 815,387, filed Dec. 31, 1985, now U.S. Pat. No. 4,667,714 and entitled Apparatus And Method For Sawing Limbs And The Like.

TECHNICAL FIELD

The present invention relates to an apparatus and method for cutting limbs or the like. More particularly, it relates to the provision of a sawbuck for holding and maintaining a plurality of limbs or the like snugly together, in a bundle, while they are being cut by a saw, and to a method of holding and stabilizing the members while they are being cut.

BACKGROUND ART

Tree limbs are denser than the tree trunks and as a result they contain more Btu's of energy. However, it has been both difficult and time consuming to cut limbs. It takes a considerable amount of time to cut limbs if they are cut individually. Limbs are generally curved and/or crooked and do not normally lay tight together. Thus, if a group of limbs are merely stacked on top of each other, on a support, and then sawn, cutting the limbs results in movement of the limbs which makes it difficult to cut them and also makes the cutting dangerous.

My copending application Ser. No. 815,387 sets forth an apparatus and method for cutting together a large number of limbs without the shifting in position of the limbs which makes the cutting operation both difficult and dangerous. This application relates to improvements in the apparatus, and in particular to ways of constructing the apparatus so that it can be disassembled for easy transportation and storage in a small space.

Sawbucks which exist in the patent literature, and which comprise a frame and some sort of means for binding members to be cut to the frame, are disclosed by the following U.S. Pat. Nos. 194,229, granted Aug. 14, 1877, to Henry C. Emery; 691,633, granted Jan. 21, 1902, to Melvin Jincks and Clarence W. Stanton; 2,815,131, granted Dec. 3, 1957, to J. E. Lunsman et al.; 4,454,929, granted Jan. 19, 1984, to David Wellman; 4,457,504, granted Jul. 3, 1984, to Gilbert E. Mottla; and 4,566,559, granted Jan. 28, 1986, to Christianus M. A. J. van Asten. These patents should be carefully considered for the purpose of putting the subject invention into proper perspective relative to the prior art.

DISCLOSURE OF THE INVENTION

In accordance with a basic aspect of the invention, a sawbuck is provided for holding limbs or other narrow members together in a bundle, for cutting, and for restraining both the bundle and the individual limbs from unwanted movement while cutting is taking place.

The term "sawbuck" is used herein in a broad sense, to denote an apparatus used for holding something as it is being cut by a saw, e.g. a chain saw.

Basically considered, a sawbuck constructed in accordance with the present invention comprises a frame which includes a support base and frame portions which extend upwardly from the support base and include corner posts, and which are detachably connected to the support base so that the sawbuck can be broken down for transportation into storage.

In accordance with an aspect of the invention, the frame comprises a support base having two sides and two ends. An end frame is provided at each end. The end frames are connectable to the support base and each comprises a pair of spaced apart posts, each of which includes a lower end portion. Box and pin joints secure the end frames to the support base. In preferred form, the boxes are short sections of rectangular tubing secured to the support base and the pins are the lower portions of the posts.

According to another aspect of the invention, the end frames each include a narrow member support which extends between the posts. The posts extend upwardly from the narrow member supports, giving the end frames an H-shape, and forming a narrow member receiving space between the posts, and above the narrow member supports which is U-shaped.

The posts on one side of the sawbuck may have removable upper portions, which when removed, give the end frames an h-shape. The upper portions of the posts are removed after the limbs or other narrow members are formed into a bundle, to provide better axis to the members as they are being cut.

In accordance with another aspect of the invention, the support base comprises a pair of elongated end members which are set down on a supporting surface. These end members each include a laterally directed box at one end. Each box is aligned with the box on the other end member. The frame includes a frame section having a horizontal lower member and a pair of posts which project upwardly from the lower member. The lower member includes pins at its outer ends, positioned outwardly of the posts. These pins are insertable into the boxes on the end members, for connecting the frame section to the end members. The end members may include vertically directed boxes at their opposite ends for receiving two more posts.

In preferred form, the transverse boxes and the pins at the end of the horizontal member are square in shape, so that the frame section can be connected to the end members in either use position in which the posts are upright, or in a stowage position in which the posts are closely adjacent the end members. The posts at the second end of the end members may be stowable inside the end members.

These and other more detailed features of the invention are described below in the description of the illustrated embodiments.

BRIEF DESCRIPTION OF THE DRAWING

In the drawings, like reference numerals are used to designate like parts throughout the several views:

FIG. 6 is a view like FIG. 5, but of a third embodiment of the invention;

FIG. 7 is a detail view taken substantially along line 7—7 of FIG. 6;

FIG. 8 is an end elevational view of the sawbuck shown by FIG. 6, with two corner posts at a side of the sawbuck removed;

FIG. 9 is a view like FIG. 8, but showing the post assembly at the opposite side of the sawbuck in a stowed position;

BEST MODE FOR CARRYING OUT THE INVENTION

Figure 1:
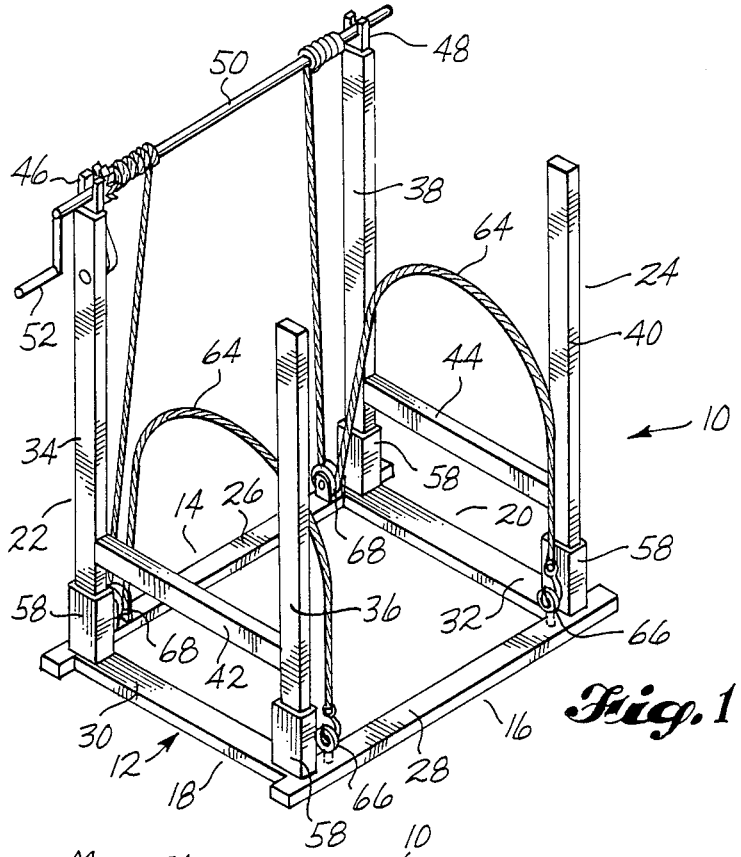
FIG. 1 is an isometric view of a first embodiment of the invention, taken from above and looking towards one side and one end of the sawbuck, and including a windlass and two bundling lines.

The sawbuck 10 shown by FIGS. 1–4 comprises a frame which in use is located in a stationary position. The frame comprises a support base 12 having two sides 14, 16 and two ends 18, 20 (FIG. 1). The frame also comprises an end frame 22, 24 at each end of the sawbuck 10.

The support base 12 may comprise a pair of side members 26, 28 connected together at their ends by a pair of end members 30, 32. In preferred form, the members 26, 28, 30, 32 are all lengths of rectangular metal tubing. The ends of the end members 30, 32 may be welded to inside side portions of the members 26, 28.

Each end frame 22, 24 may comprise a pair of spaced apart posts 34, 36 and 38, 40, interconnected by horizontal members 42, 44. Member 42 is interconnected between posts 34, 36. Member 44 is interconnected between post 38, 40. The members 34, 36, 38, 40, 42, 44 may all be lengths of metal tubing. The members 42, 44 may be welded at their ends to the members 34, 36 and 38, 40.

Posts 34, 38 may comprise saddles 46, 48 at their upper ends for receiving a windless 50 having a handle 52. The saddles 46, 48 are shown to include upwardly opening blind slots sized for receiving portions of the windless 50. A ratchet 54 may be connected to the windless 50. A pawl 56 may be attached to the post 34 and include an upper end position which engages the teeth of the ratchet 54. In a manner known per se, the ratchet teeth are constructed so that when the handle is turned in one direction (counter clockwise in FIG. 2), the pawl 56 will be pushed aside by the teeth of the ratchet 54 and the windlass 50 will rotate. However, an engagement of the upper end of the pawl 56 with the teeth will prevent rotation in the opposite direction.

The end frames 22, 24 are detachably secured to the support base 12 by box and pin joints. In preferred form, these joints comprise upwardly opening boxes 58 which are secured at their lower ends (as by welding) to the support base 12 (FIGS. 1–4). The lower end portions of the posts 34, 36, 38, 40 constitute the pins of the box and pin joints. As illustrated, the boxes 58 may be short lengths of rectangular metal tubing, sized to receive the lower end portions of the posts 34, 36, 38, 40.

Figure 2:
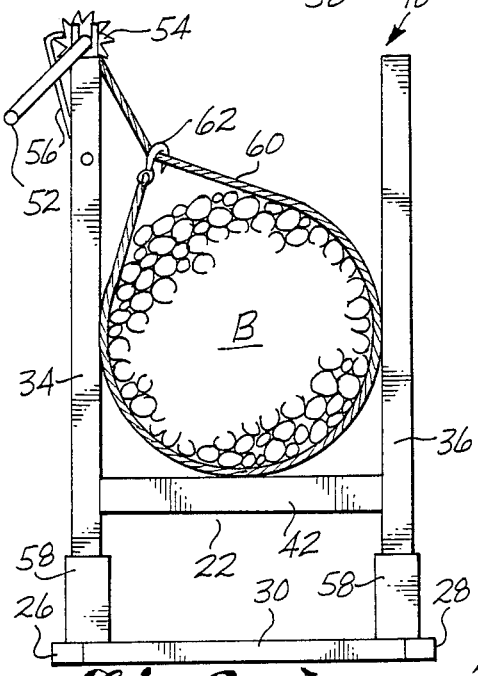
FIG. 2 is an end elevational view looking towards the left end of the sawbuck as it is pictured in FIG. 1, showing a bundle of limbs or the like contained within a noose and suspended from an upper portion of the sawbuck, so that the weight of the limbs functions to keep the noose tight.

FIG. 2 illustrates one way of forming a bundle of the limbs or other narrow members which are to be cut. Initially, the limbs are positioned on the members 42, 44. About one half of the limbs are positioned with their butt ends on member 42 and the remainder with their butt ends on member 44. Members 42, 44 support the limbs or the like and thus may be termed "narrow member supports." Then, a pair of lines 60, each with a hook 62 on its end, are brought around the narrow members and the hooks 62 is hooked onto the lines 60. The opposite ends of the lines 60 are attached to the windlass 50 at spaced apart locations. The handle 52 is then turned for the purpose of wrapping the lines 60 onto the windlass 50. The wrapping is continued until the narrow members form a bundle B, the weight of which is at least partially carried by the lines 60.

Figure 3:
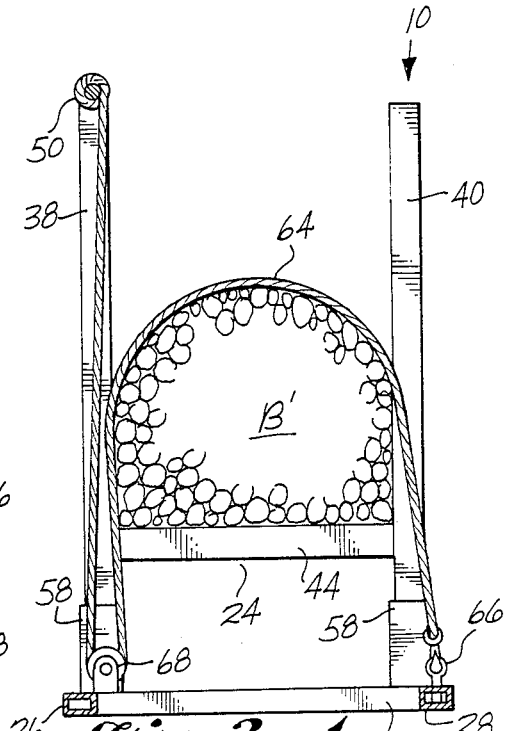
FIG. 3 is a view like FIG. 2, but showing a different use of a line or lines for holding the limbs together in a bundle while they are being cut.
Figure 4:
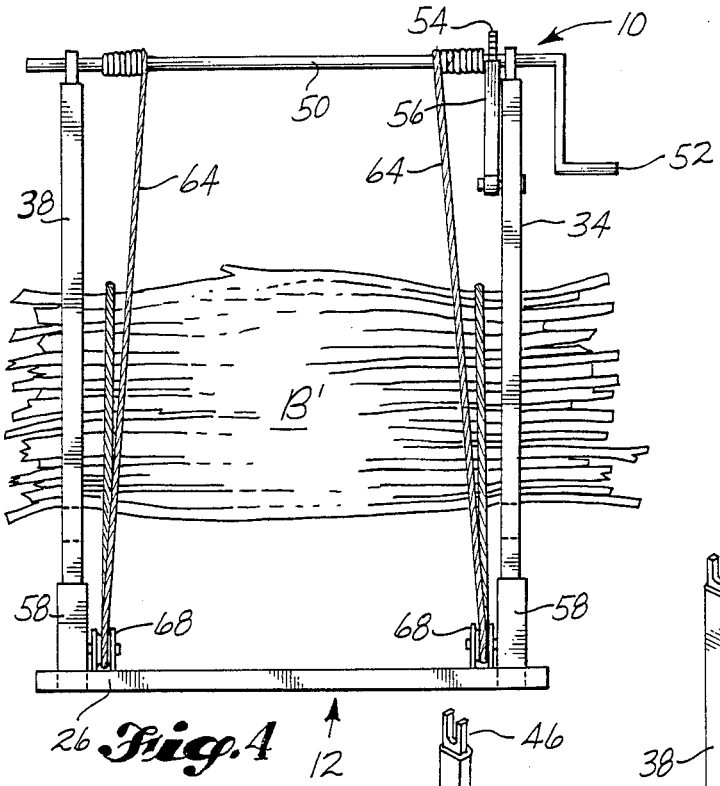
FIG. 4 is a side elevational view of the sawbuck shown in FIG. 3, said view showing a bundle of limbs, and showing a pair of lines being used for binding the limbs to the frame.

FIGS. 1, 3 and 4 illustrate a second way of forming the bundle B'. The narrow members are placed on the supports 42, 44, as before. Then, one or more lines 64 (preferably two), each having a lower end 66 secured to a lower side portion of the frame, are brought up and over the narrow members. The line or lines 64 are then directed downwardly to and around a pulley 68 that is secured to the opposite side portion of the frame. The line or lines 64 then extend upwardly to the windlass 50 and are attached to the windlass 50. The windlass 50 is then rotated to wrap the upper end portion of the line or lines 64 on it. This causes the line portion or portions which overlay the bundle B' to bind the narrow members tightly together and against the supports 52, 54.

Figure 5:
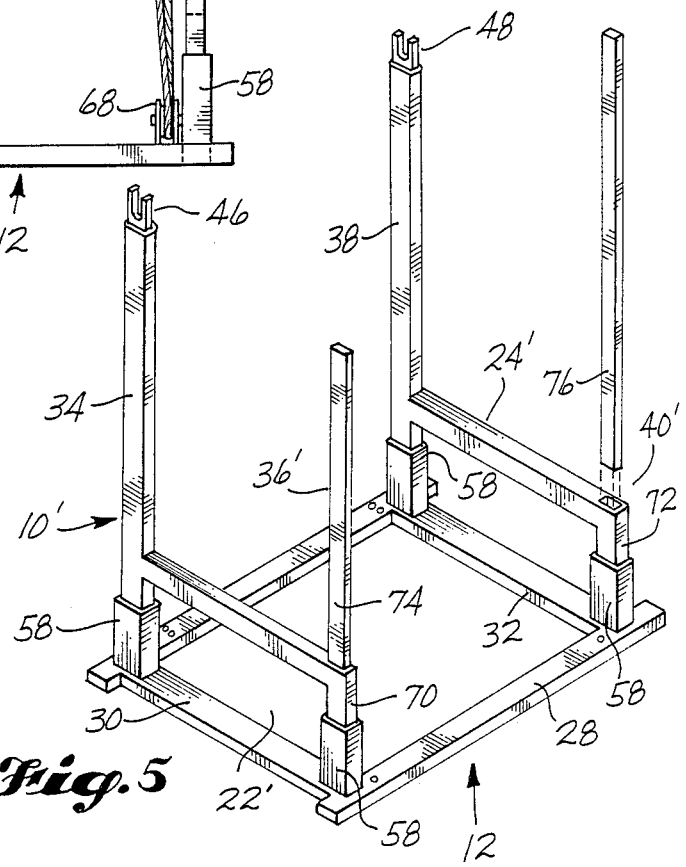
FIG. 5 is a view like FIG. 1, but of a second embodiment of the sawbuck, with the windlass and bundling line(s) omitted, such view showing a detachable upper portion of a corner post in spaced relationship to its installed position.

FIG. 5 shows a modified construction of the sawbuck 10' which differs from the sawbuck 10 only in that the post 36', 40', of the end members 22', 24', are of a two-piece construction. Each post 36', 40' has a lower part 70, 72, extending below its support member 42, 44, and a detachable upper part 74, 76. The upper ends of the lower parts 36', 40' are open, to form a box or socket for receiving the lower end portions of the members 74, 76. Members 74, 76 may be lengths of rectangular metal tubing sized to snugly fit within the metal tubing members 36', 40'.

When the upper parts 74, 76 are connected to the lower parts 70, 72, the end frames 22', 24' are H-shaped, the same as the end frames 22, 24 of the first embodiment. When the upper parts 74, 76 are removed, the end frames 22', 24' are h-shaped.

FIGS. 6–9 show a third embodiment of the sawbuck. This embodiment is designated 78. It also comprises a support base and four corner posts. First and second posts 80, 82 are interconnected at their bottoms by a side member 84. The third and fourth posts 86, 88 are separate members. The connection together of posts 80, 82 provides a substantially fixed distance between saddles 46, 48.

The support base comprises a pair of end members 90, 92, each of which may be in length of metal tubing. A pair of horizontal boxes 94, 96 are connected to the end members 90, 92, at a first side 98 of the sawbuck 78. When the end members 90, 92 are set down in a parallel position on a support surface, horizontal box openings in boxes 94, 96 are each in alignment with the other. Member 84 includes end portions 100, 102 which project endwise outwardly from the post 80, 82. These end portions 100, 102 form pins which are snugly received within the openings of boxes 94, 96. The boxes 94, 96 may be constructed from U-shaped pieces of metal which are welded at their lower ends to the end members 90, 92. Members 94, 96 may be constructed from short lengths of metal tubing from which one side has been cut away, to provide an open side. The open side is then directed downwardly and the lower ends of the end walls are welded to the end members 90, 92. Or, members 94, 96 may be short lengths of tubing welded to members 90, 92.

As shown by FIG. 7, short lengths of tubing 104 may be embedded in the opposite ends of the end members 90, 92, to form upwardly opening boxes for receiving the lower "pin" forming end portions of the posts 86, 88. Openings equal in size and shape to the outside dimension of the members 104 may be cut into the upper walls of the end members 90, 92. The members 104 may be of a length extending from the upper surface of the lower walls of the members 90, 92 up to the upper surface of the upper walls of the members 90, 92. The lower ends of the members 104 may be welded at 106 to the lower walls of the members 90, 92. A ring weld 108 may be used to connect the upper ends of the members 104 to the upper walls of the end members 90, 92. The removable posts 86, 88 may be constructed from lengths of metal tubing, the outside dimension of which is sized and shaped to snugly fit within the inside dimension of the members 104.

In use, a pair of cables are layed on the ground between the end frames 80, 86, 90 and 82, 88, 92. The cables are layed out to extend generally parallel to the members 90, 92, and over the member 84. Then, the limbs are stacked on top of the tables. As shown by FIG. 2, a hook 62 at one end of each cable is brought around the bundle and hooked onto its cable 60. The opposite end of the cable 60 is secured to the windlass 50. The windlass 50 is turned to tighten the noose about the bundle and tighten the cables 60 so that they will carry at least some of the weight of the limbs. The posts 86, 88 may then be removed for the purpose of providing better access to the limbs, for cutting. As stated above, the limbs are placed on the cable with approximately one half of the butts to one side and the remaining butts to the opposite side. This produces a more uniform bundle diameter so that the two regions of the bundle surrounded by the two cables are substantially equal in circumference and the cable lengths are substantially equal. This arrangement of the limbs, in which butt ends are interspursed with limb tops, results in the larger, relatively stiff butt ends supporting the smaller, relatively flexible limb tops, during the cutting process. This results in a more trouble-free cutting operation.

As shown by FIGS. 8 and 9, if the end portions 100, 102 of the member 84 are square in shape, and if the box openings in the box members 94, 96 are also square in shape, the end portions or pins 100, 102 may engage the boxes 94, 96 in two different positions. In the position shown by FIG. 8, the post 80, 82 extend vertically upwardly from the support base, i.e. from members 90, 92. As shown by FIG. 9, the end members 90, 92 can be moved apart, to move the pins 100, 102 out from the boxes 94, 96. Then, the assembly 80, 82, 84 can be rotated ninety degrees to place the posts 80, 82 adjacent the end members 90, 92, and then the pins 100, 102 can be reassembled into the boxes 94, 96. As shown by FIG. 9, this results in the sawbuck 78 having a stowed position in which the assembly 80, 82, 84 is in juxtaposition with the support base members 90, 92. The posts 86, 88 can be slid endwise into the members 90, 92 through open ends at the first side of the sawbuck 78.

Figure 10:
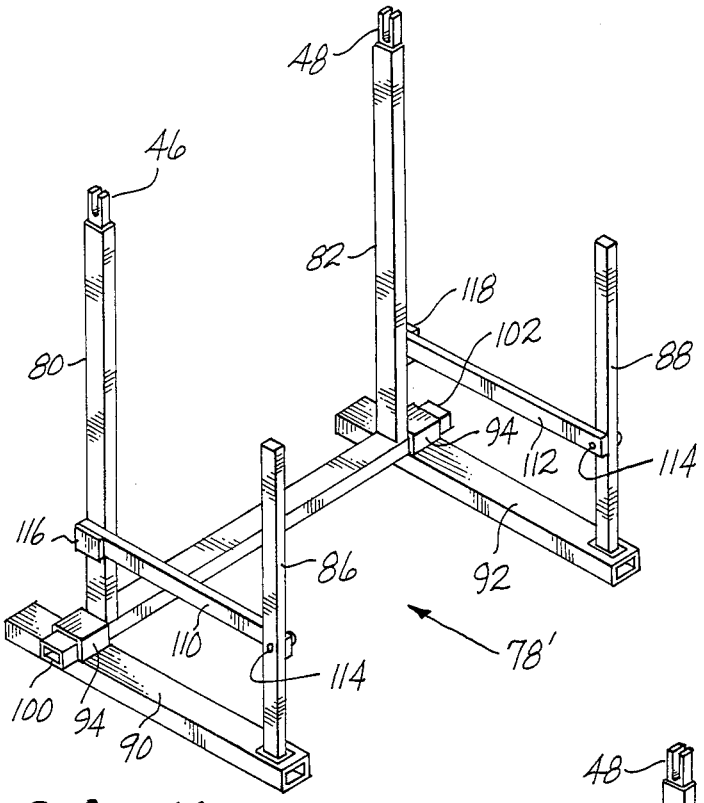
FIG. 10 is a view like FIGS. 5 and 6, but of a fourth embodiment of the invention.

FIG. 10 discloses a sawbuck 78' that is like the sawbuck 78 shown by FIGS. 6 and 7 except that it includes narrow member supports 110, 112. The members 110, 112 are hinge connected to the post 86, 88, such as by the use of hinge pins 114. The opposite ends of the supports 110, 112 are received in upwardly opening saddles 116, 118 which are secured to outside portions of the posts 80, 82, as illustrated.

Figure 11:
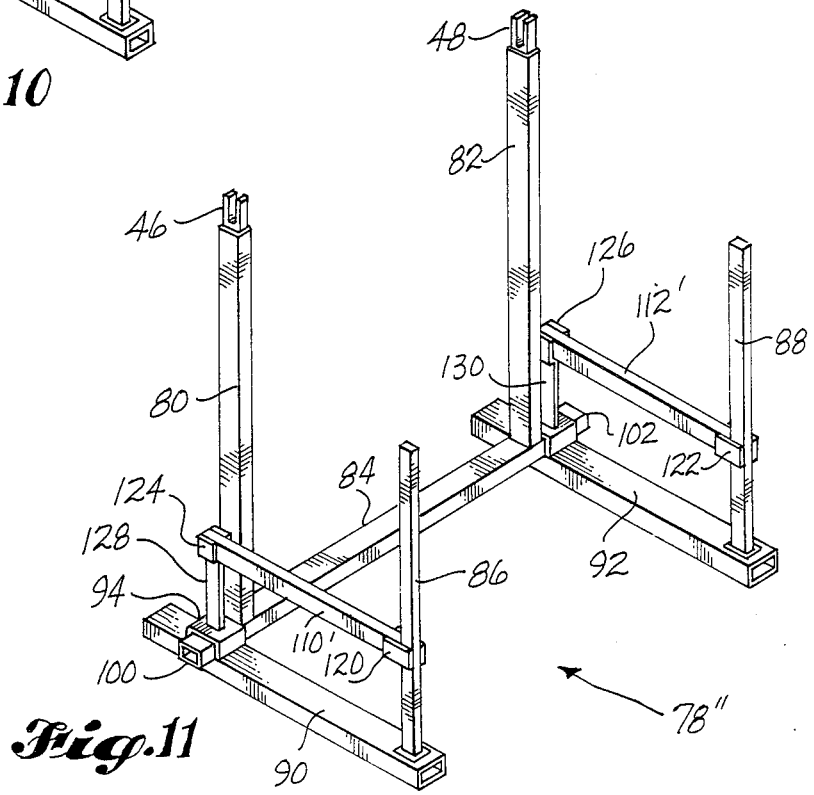
FIG. 11 is a view like FIGS. 5, 6 and 10, but of a fifth embodiment of the invention.

The sawbuck 78" shown by FIG. 11 is also very much like the sawbuck 78 shown by FIGS. 6 and 7. This embodiment also includes narrow member supports 110', 112'. However, in this embodiment, the posts 86, 88 are provided with upwardly opening saddles 120, 122, for receiving end portions at the support members 110', 112', at one side of the sawbuck 78". Upwardly opening saddles 124, 126 are provided at the opposite side of the sawbuck 78", laterally outwardly adjacent the posts 80, 82. The saddles 124, 126 are U-shaped and each is connected to the upper end of a post 128, 130, the lower end of which is connected (such as by welding) to the top of a box member 94, 96.

The embodiment shown by FIGS. 6–9 is simple in construction and has relatively few parts. As stated, the side assembly 80, 82, 84 may be stowed in a position with the posts 80, 82 against the end members 90, 92, and the posts 86, 88 may be slipped into the end members 90, 92. This compacting of the sawbuck 78 makes it easier to carry and it takes up less space, both when being transported and when in storage.

The embodiment shown by FIGS. 10 and 11 are also relatively simple. They are provided with elevated small member supports 110, 112. This allows the cables to be inserted into position below the limbs or other members, after they have been stacked on the elevated supports 110, 112. Following bundling of the limbs or other members, by use of the cable 60 and the windlass 50, the posts 86, 88 and the elevated supports 110, 112 can be removed, leading the bundle against the posts 80, 82, and supported from the windlass 50.

Figure 12:
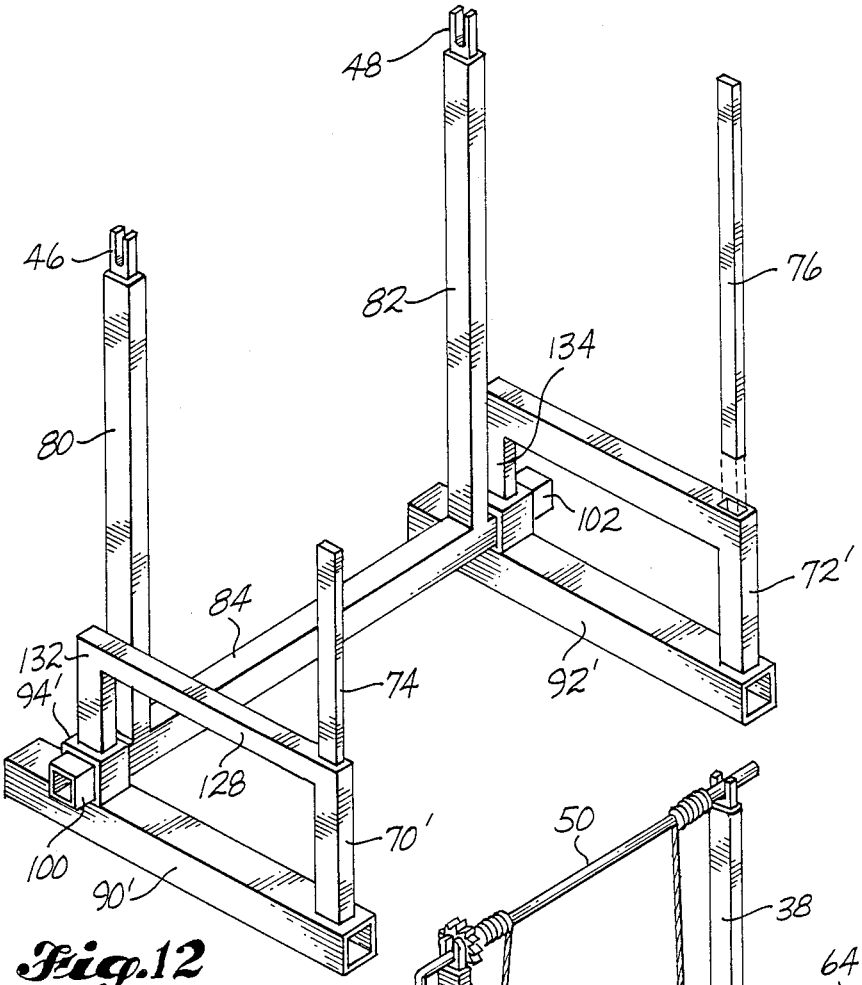
FIG. 12 is a view like FIGS. 5, 6, 10 and 11, but of a sixth embodiment of the invention.

The embodiment shown by FIG. 12 combines features that are in the embodiment shown by FIG. 5 with features that are in the embodiment shown by FIG. 6. Referring to FIG. 12, the sawbuck includes spaced apart posts 80, 82 connected at their lower ends to a horizontal beam 84. End portions 100, 102 of the beam 84 form pins which fit into laterally directed boxes 94', 96'. The boxes 94', 96' are secured to end portions of the lower end members 90', 92'. At the side of the sawbuck opposite the posts 80, 82, lower post sections 70', 72' are provided. They are connected at their lower ends to the ends of members 90', 92' opposite the boxes 94', 96'. The post sections 70', 72' have open upper ends into which removable upper post sections 74, 76 are inserted. Elevated limb supports 128, 130 extend horizontally from the upper ends of the post sections 70', 72' to upper ends of post members 132, 134. The lower ends of post members 132, 134 are secured to the upper portions of the box members 94', 96'.

The end frames 70', 90', 128, 132 and 72', 92', 130, 134 are detachably connected to the side assembly 80, 82, 84. This is done by a simple insertion of the pins 100, 102 into the boxes 94', 96'. As in the embodiment shown by FIG. 5, the upper post members 74, 76 are installed. Then, limbs or other articles to be cut are placed on the support members 128, 130, between posts 74, 80 and 76, 82. A line means is used to bind the limbs or other members into a bundle. Then, the post sections 74, 76 are removed.

Figure 13:
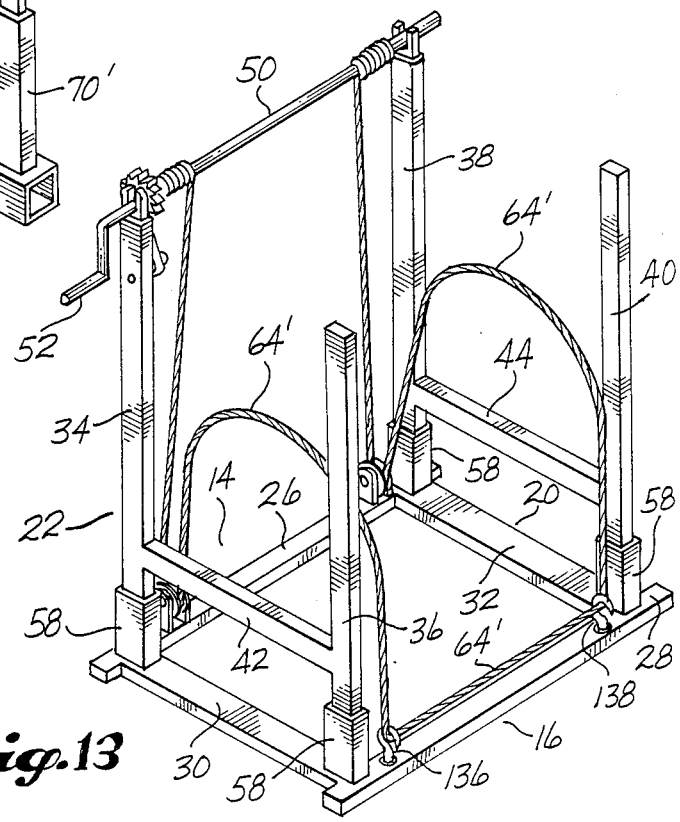
FIG. 13 is a view like FIG. 1, but showing the use of a continuous single line member.
Figure 14:
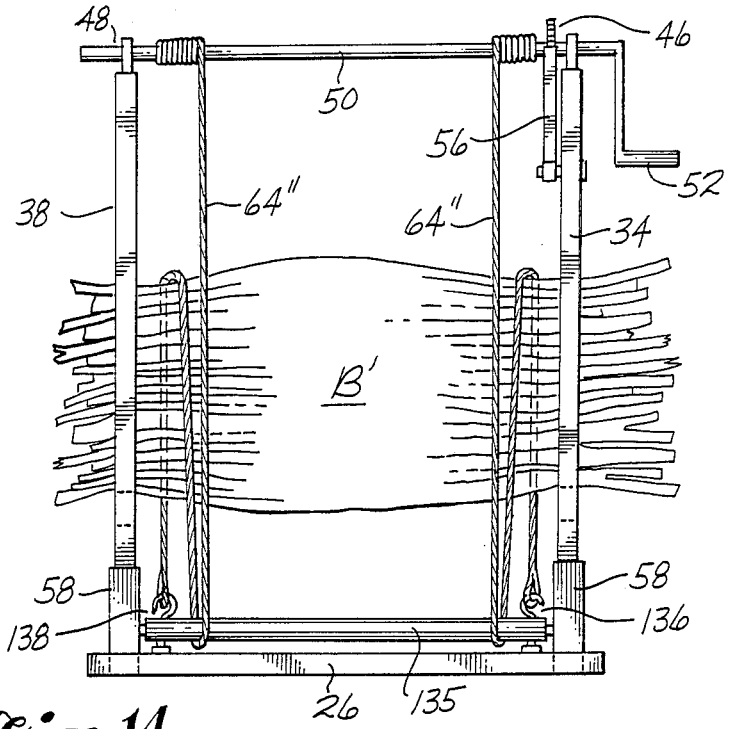
FIG. 14 is a view like FIG. 4, but showing the use of a single continuous line member and a roller on the windlass side of the sawbuck, in place of a pair of pulleys.

FIG. 13 shows a modified use of line means for binding the members to be cut against the support member portions of the end frames. In this embodiment, a single line 64' is used. It is connected at its two ends to the windlass 50. It extends from the windlass 50 downwardly to and around suitable bearing means. This bearing means may be individual pulleys, as illustrated in FIG. 13. Or, it may be a single elongated roller 135, as illustrated in FIG. 14. The line parts then extend upwardly from the pulleys 68 or roller 68' over the limbs or other members to be cut, and then downwardly to bearings 136, 138. These bearings may be in the form of hook members. The line 64' extends horizontally between the bearings 136, 138. The advantage of this arrangement is that the line 64' will automatically adjust to unequal dimensions of the bundle of members to be cut at the opposite ends of the sawbuck. As previously stated, it is preferable that limbs be stacked in the sawbuck with approximately fifty percent of the butts towards one end and the remaining approximately fifty percent towards the opposite end. This arrangement of the limbs results in a substantially uniform bundle dimension. Also, the thicker butts nested in with the thinner opposite ends serve to reinforce the thinner ends during cutting. The use of a single continuous line 64' assures that the tension in the line will be equal. If a first of the loops contacts the members to be cut before the second loop does, the first loop will enlarge and in the process pull line from the second loop. In a short time, both of the loops will be exerting a squeezing, bundling force on the members.

Hooks 136, 138 have been illustrated and these are a simple form of bearing. However, it is to be understood, that any suitable bearing for changing direction of the line means, in the manner illustrated, can be used in place of the hooks 136, 138. Another advantage of the use of hooks is that the line can be easily attached and detached from the hooks.

Referring to FIG. 14, a roller 135' is shown used in place of the two pulleys 68. An advantage of the roller 135' is that it allows the line (64') or lines (68'') to seek their own alignment with the windlass 50 and the bundle B'.

In FIG. 14 the roller 135' is shown used with two lines 64'' and the hooks 136, 138. However, it could also be used with a single line 64', such as shown in FIG. 13. The hook and eye connection shown by FIG. 14 is another way of connecting the line sections 64 to the frame.

The present invention includes the use of one or more features from an illustrated and described embodiment with one or more features from one or more of the other illustrated and described embodiments. For example, each of the several line uses for forming a bundle that have been illustrated and described can be used with each of the sawbucks which have been illustrated with the windlass and line means omitted.

The embodiments which have been described above are presented for example purposes only. The invention is not to be limited by the details of these example embodiments, but only by an interpretation of the following claims. It is intended that the claims cover devices which meet the literal terms of the claims, and equivalent devices as well.

What is claimed is:

1. A sawbuck for use in cutting narrow members such as limbs or the like, comprising:

a frame which in use is located in a stationary position, said frame comprising a support base having two sides and two ends, an end frame at each end connectable to said support base, each said end frame comprising a pair of spaced apart posts, each of which includes a lower end portion, and a narrow member support extending between the posts, with the two narrow member supports of the two end frames together providing a support for a plurality of narrow members to be cut;

line means connected to and cooperating with said frame to hold and maintain a plurality of such narrow members snugly together in a bundle while they are being cut by a saw; and box and pin joints for detachably securing the lower end portions of the posts to the support base.

2. A sawbuck according to claim 1, wherein the lower end portions of the posts form the pins and the support base is provided with a box for each said pin.

3. A sawbuck according to claim 1, wherein on one side of the support base the posts comprise means at their upper ends for supporting a windlass in the form of an elongated rotatable bar, and said line means is partially wound onto said elongated bar.

4. A sawbuck according to claim 1, wherein the posts are constructed from tubular metal, and wherein said boxes and pins are constructed from tubular metal, and the pins are dimensioned to be snugly received within the boxes.

5. A sawbuck according to claim 1, wherein on a first side of the support base the posts project upwardly from the support base a distance substantially higher than the narrow member support, wherein the posts on the opposite side of the support base include lower portions having upper ends positioned at substantially the level of the narrow member support, and further comprise upper portions and pin and box joints connecting said upper portions to said lower portions.

6. A sawbuck according to claim 5, wherein said post lower portions are formed from tubular metal, and each has an upwardly opening box at its upper end, and the lower ends of the upper portions of such posts are receivable in said boxes, and constitute the pins of the joints.

7. A sawbuck according to claim 5, wherein when the upper portions of the posts on said opposite side of the support base are connected to the lower portions of such posts, the end frames have a substantially H-shape, and when such upper portions are disconnected from the lower portions, the end frames have a h-shape.

8. A sawbuck according to claim 1, wherein each end frame has a generally H-shape.

9. A sawbuck according to claim 1, wherein the support base and the end frames together define an open space between the two end frames and above the support base.

10. The sawbuck according to claim 9, wherein the support base has a generally planar main portion and components of the box and pin joints which extend upwardly from corner portions of said main portion.

11. A sawbuck according to claim 1, wherein said support base comprises a pair of parallel, spaced apart elongated end members, each of which comprises a laterally directed box at one end that is in alignment with the box on the opposite end member, wherein such boxes are positioned at one side of the support base, and at such side of the sawbuck the frame comprises a horizontal lower member having a pin at each end, and a pair of posts extending upwardly from the horizontal member inwardly of said pins, and wherein each said pin extends into a related one of said boxes.

12. A sawbuck according to claim 1, wherein on the second side of the support base the end portions of the two elongated end members include vertically oriented boxes, and the sawbuck frame further includes a pair of posts at said side, each having a lower end portion defining a pin which is receivable within a related one of the boxes.

13. A sawbuck according to claim 10, wherein the transverse boxes at the first side of the support base are short lengths of square tubing, and the pins which fit into said boxes are square members sized to snugly be received within said transverse boxes.

14. A sawbuck for use in cutting narrow members such as limbs or the like, comprising:

a frame comprising a support base characterized by a pair of parallel, spaced apart, elongated end members, each of which comprises a laterally directed box at one end that is in alignment with the box on the opposite end member, and each said end member having a vertically upwardly opening box adjacent its opposite end; and said frame also comprising a frame section which includes a horizontal lower member having a pin at each end, and first and second spaced apart posts extending upwardly from the horizontal member, each said post being positioned immediately inwardly adjacent one of said pins, and wherein said pins are sized to fit into the laterally directed boxes;

said frame further comprising third and fourth post members, having lower end portions sized to be received within the vertical boxes at the opposite ends of the elongated end members.

15. The sawbuck according to claim 14, wherein each laterally directed box includes a laterally directed rectangular box opening, and the pin which fits within said box component is rectangular and sized to snugly fit within the rectangular opening.

16. A sawbuck according to claim 15, wherein the box openings and the pins at the ends of the horizontal member are square, enabling the pins to be inserted into the boxes in both said position in which the posts extend upwardly perpendicular to the end members, and a second position in which the posts are parallel and adjacent the end members.

17. A sawbuck according to claim 14, wherein the end members are lengths of rectangular tubing, and the vertical box components are short lengths of rectangular tubing which are inset into end portions of the end members, and have inside dimensions sized to snugly receive the lower end portions of the third and fourth post members.

18. A sawbuck according to claim 14, wherein the upper ends of the first and second post members includes means for receiving and supporting a windlass.

19. A sawbuck according to claim 14, further comprising first and second narrow member supports, each being an elongated member having first and second ends, and each being spaced vertically above a different one of the end members, with the first end of the first narrow member support being connected to the third post, and the first end of the second narrow member support being connected to the fourth post.

20. A sawbuck according to claim 19, wherein said frame includes a pair of upwardly opening saddles adjacent the first and second posts, positioned to receive the second ends of the narrow member supports.

21. A sawbuck according to claim 14, wherein the lower ends of the first and second post are rigidly secured to the horizontal lower member by connections which maintain the first and second posts in substantially fixed positions so that the horizontal spacing between said first and second posts is maintained substantially fixed.

22. A sawbuck for limbs or the like, comprising:

frame means defining a support for a plurality of members to be cut, said frame means having first and second sides;

a windlass on the first side of the frame, elevated above said support;

first and second line sections connected to the windlass, in spaced apart locations, each line section extending downwardly from the windlass to the lower portion of the frame;

guide means for the line sections mounted at said lower portion of the frame, each line section extending below the guide means and then extending upwardly and over members to be cut which are on the support, and then extending downwardly to a lower frame location on the opposite side of the frame;

means at said opposite side of the frame for anchoring the line sections so that rotation of the windlass to put tension in the line sections will cause the line sections to tightly bind the members to be cut against the support portions of the frame.

23. A sawbuck according to claim 22, wherein the line sections are portions of a continuous line member and the anchor means at the opposite side of the frame comprise bearing means engaging the line member and said line member includes a straight section extending between the bearing means.

24. A sawbuck according to claim 22, wherein the guide means at the first side of the frame comprises a single elongated roller below which each of the line sections extend, said roller being mounted for rotation about an axis that is parallel to the axis of the windlass.

25. A method of sawing a plurality of limbs or like members which are relatively small in cross sectional shape and at least some of which taper in size from one end towards the other, comprising:

positioning such members on a support, with the larger ends of substantially one half of the members directed in one direction and the large end of the remaining members directed in the opposite direction;

holding the members relatively fixed in position on the support, and bundling them together, by use of a single continuous line, to exert a squeezing force on the members, including by connecting opposite end portions of such line to a windlass at spaced apart locations, then directing such end portions of the lines down to and under guide means located below the support, and then up and over the members on the support, and then down to spaced apart bearing means, and through the bearing means, with the line sections being joined together between the bearing means, and rotating the windlass to tension the line sections, so that the smaller ends of the members will be bundled tightly with the larger ends of adjacent members and such smaller ends will be stiffened by the larger ends, and so that the first line section to squeeze the bundle of members will pull line from the opposite line section until the two line sections exert substantially equal squeezing forces on the bundle of members and automatically compensate for size differences where the two line sections contact the bundle; and using a saw to cut across the bundle.

* * * * *

UNITED STATES PATENT AND TRADEMARK OFFICE

CERTIFICATE OF CORRECTION

PATENT NO. : 4,756,351

DATED : July 12, 1988

INVENTOR(S) : Morris N. Knutsen

It is certified that error appears in the above-identified patent and that said Letters Patent are hereby corrected as shown below:

Column 1, line 29, "sawn" should be -- sawed --.
Column 2, line 24, "axis" should be -- access --.
Column 4, line 19, "is" should be -- are --.
Column 4, line 65, "in" should be -- a --.
Column 5, line 34, "layed" should be -- laid --.
Column 5, line 36, "layed" should be -- laid --.
Column 5, line 54, "interspursed" should be -- interspersed --.
Column 5, line 63, "post" should be -- posts --.
Column 6, line 45, "leading" should be -- leaving --.
Claim 7, column 8, line 56, "a" should be -- an --.
Claim 12, column 9, line 10, "claim 1," should be -- claim 11, --.
Claim 18, column 9, lines 62 and 63, "includes" should be -- include --.
Claim 25, column 10, lines 59 and 60 should be in one paragraph.

Signed and Sealed this

Twenty-first Day of February, 1989

*Attest:*

DONALD J. QUIGG

*Attesting Officer*

*Commissioner of Patents and Trademarks*